US012102214B2

(12) United States Patent
Campbell et al.

(10) Patent No.: US 12,102,214 B2
(45) Date of Patent: Oct. 1, 2024

(54) BACKPACK WITH LEVELING STRUCTURE

(71) Applicant: Under Armour, Inc., Baltimore, MD (US)

(72) Inventors: Derek Campbell, Baltimore, MD (US); Bradley Johnson, Salt Lake City, UT (US); Seden Craig, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 16 days.

(21) Appl. No.: 17/688,274

(22) Filed: Mar. 7, 2022

(65) Prior Publication Data

US 2022/0279913 A1 Sep. 8, 2022

Related U.S. Application Data

(60) Provisional application No. 63/157,987, filed on Mar. 8, 2021.

(51) Int. Cl.
*A45F 3/04* (2006.01)

(52) U.S. Cl.
CPC ..... *A45F 3/047* (2013.01)

(58) Field of Classification Search
CPC . A45C 13/30; A45F 3/04; A45F 3/042; A45F 3/047; A45F 3/12; A44B 11/02; A44B 11/04
USPC ..... 224/627
See application file for complete search history.

(56) References Cited

U.S. PATENT DOCUMENTS 5,725,139 A 3/1998 Smith
7,028,873 B1 4/2006 Collier et al.
7,232,048 B2 6/2007 Le Gal et al.
7,431,184 B2 10/2008 Gregory
(Continued)

FOREIGN PATENT DOCUMENTS

AU 2009222552 A1 4/2010
CN 108056567 A * 5/2018
(Continued)

OTHER PUBLICATIONS

CN-111358149-A Translation, Peng X, Jul. 2020 (Year: 2020).*
(Continued)

*Primary Examiner* — Nathan J Newhouse
*Assistant Examiner* — Matthew T Theis
(74) *Attorney, Agent, or Firm* — Edell, Shapiro & Finnan, LLC

(57) ABSTRACT

A backpack includes a main body including a front side and a rear side, a pair of shoulder straps, each shoulder strap extending from a first fixed end at an upper portion of the rear side to a second free end, and a shoulder strap leveling structure coupled with each of the shoulder straps. Each shoulder strap leveling structure is coupled with a corresponding shoulder strap and includes a slip lock member disposed along a portion of the corresponding shoulder strap, and a bulk strap including a first end coupled with the rear side of the backpack and a second free end that is moved through a slot of the slip lock member. Each bulk strap also includes a plurality of markings arranged along a length dimension of the bulk strap that are visible through a window of the slip lock member.

15 Claims, 13 Drawing Sheets

(56) References Cited

U.S. PATENT DOCUMENTS

| | | | | |
|---|---|---|---|---|
| 8,998,051 | B2 | 4/2015 | Demskey | |
| 9,591,910 | B2 | 3/2017 | Kemp et al. | |
| 10,463,138 | B1 | 11/2019 | Boutin et al. | |
| 2002/0145018 | A1* | 10/2002 | Godshaw | A45F 3/04 224/580 |
| 2004/0065708 | A1 | 4/2004 | Amram | |
| 2008/0156835 | A1* | 7/2008 | Schlipper | A45F 3/12 224/264 |
| 2017/0311702 | A1* | 11/2017 | Coutant | A45C 13/02 |

FOREIGN PATENT DOCUMENTS

| | | | | | |
|---|---|---|---|---|---|
| CN | 111358149 | A | * | 7/2020 | |
| EP | 1457131 | A1 | | 9/2004 | |
| EP | 2967207 | B1 | | 11/2019 | |
| FR | 2677235 | A1 | * | 12/1992 | A45F 3/047 |
| FR | 2677235 | B1 | | 9/1993 | |
| WO | 9426143 | A1 | | 11/1994 | |
| WO | 02058506 | A1 | | 8/2002 | |
| WO | 2017223064 | A1 | | 12/2017 | |

OTHER PUBLICATIONS

FR-2677235-A1 Translation, Quatrehomme R, Dec. 1992 (Year: 1992).*
CN-108056567-A Translation, Ito N, May 2018 (Year: 2018).*

* cited by examiner

BACKPACK WITH LEVELING STRUCTURE

CROSS-REFERENCE TO RELATED APPLICATIONS

This application claims priority from U.S. Provisional Patent Application Ser. No. 63/157,987, filed Mar. 8, 2021, and entitled "Backpack With Leveling Structure", the disclosure of which is incorporated herein by reference in its entirety.

FIELD OF THE INVENTION

The present invention relates to a backpack.

BACKGROUND OF THE INVENTION

Backpacks are popular on college campuses as well as in business environments for transporting items and even portable electronic devices, such as laptops, smart phones, etc. With the number of items a person may need to transport with them for any given scenario, it is often desirable to provide further features for a backpack to enhance its versatility and functionality. For example, depending upon a number and/or types of items stored within the backpack, it may be desirable to ensure the backpack load is distributed evenly across the user's back and shoulders, where the loops defined by the straps attached to the backpack are substantially even or of the same or similar lengths during use, and further where the contents to be carried within the backpack can be evenly distributed within enclosures or pockets of the backpack.

BRIEF SUMMARY OF THE INVENTION

In example embodiments, a backpack comprises a main body including a front side and a rear side, a pair of shoulder straps, each shoulder strap extending from a first fixed end at an upper portion of the rear side to a second free end, and a shoulder strap leveling structure coupled with each of the shoulder straps. Each shoulder strap leveling structure is coupled with a corresponding shoulder strap and comprises a slip lock member disposed along a portion of the corresponding shoulder strap at a location closer to the second free end in relation to the first fixed end of the corresponding shoulder strap, and a bulk strap including a first end coupled with the rear side of the backpack and a second free end that is moved through a slot of the slip lock member for the corresponding shoulder strap to slidably couple the bulk strap with the slip lock member and releasably couple the bulk strap with the corresponding shoulder strap. Each bulk strap includes a plurality of markings arranged along a length dimension of the bulk strap, and each slip lock member includes a window through which a single marking of the plurality of markings is visible when the bulk strap of the corresponding shoulder strap is moved to different positions in relation to the slip lock member.

The leveling structure of the backpack facilitates an alignment, leveling and/or balancing of the backpack in relation to the shoulders and back of the user when the backpack is worn. Additional (non-limiting) features of the backpack include side straps that extend between front and rear sides of the backpack and that facilitate pulling of the backpack toward the user's shoulders and back when the backpack is worn by the user. Compartments or pockets of the backpack are further provided in suitable (e.g., symmetrical) alignments so as to facilitate a suitable balancing of the weight or load of the backpack when the backpack is filled with contents to be supported when the backpack is worn by the user.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As described herein, a backpack includes leveling features integrated or incorporated with the backpack straps to provide alignment or leveling of the alignment for the backpack on the user's shoulders as well as along the user's back. This leveling feature facilitates a proper or uniform alignment and loading of the weight of the backpack being supported by the user's shoulders and back.

Figure 1A:
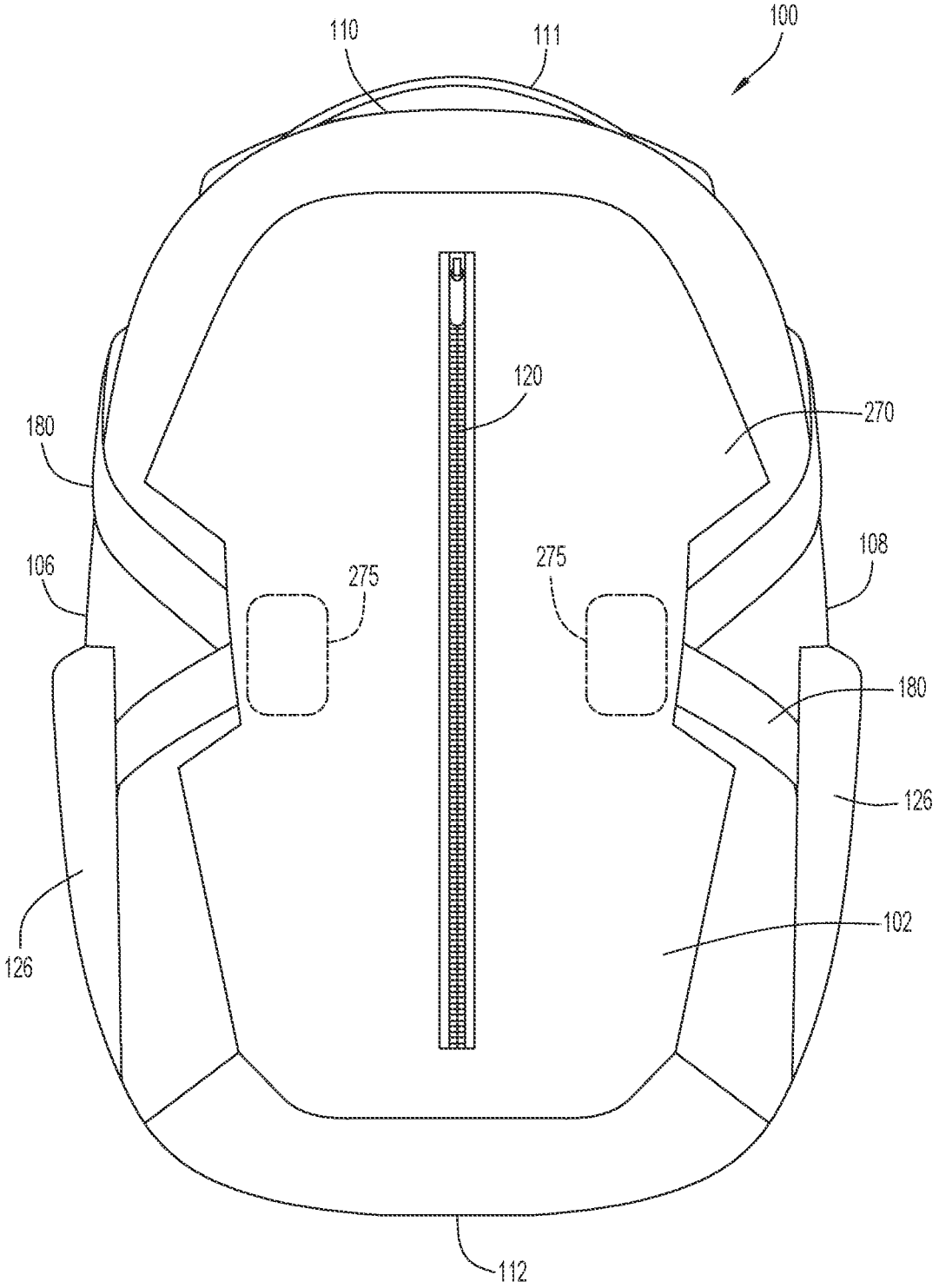
FIG. 1A is a front view of a backpack in accordance with an embodiment of the invention.
Figure 1B:
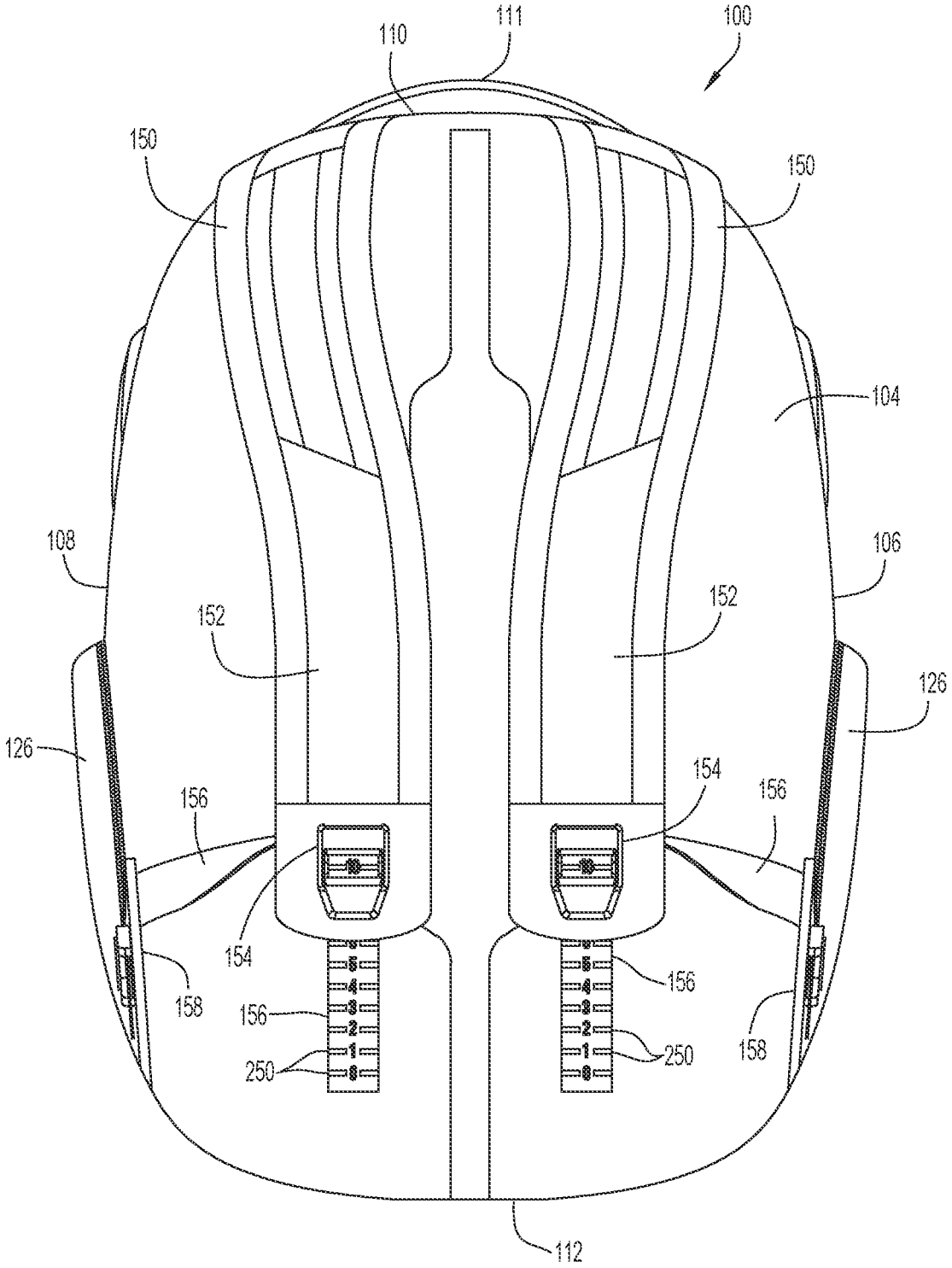
FIG. 1B is a rear view of the backpack of FIG. 1A, showing shoulder straps with leveling features.
Figure 1C:
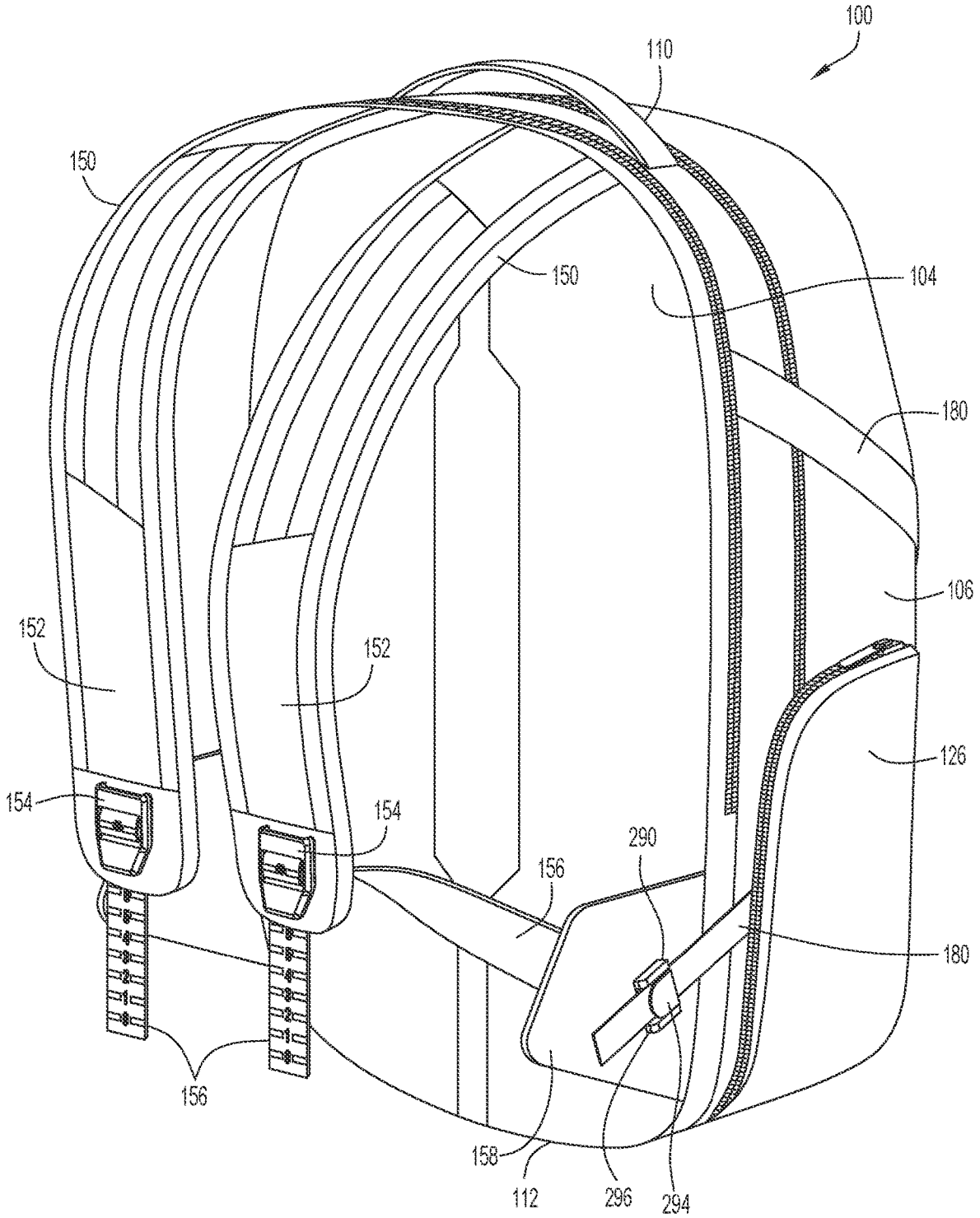
FIG. 1C is a rear perspective view of the backpack of FIG. 1A.
Figure 2A:
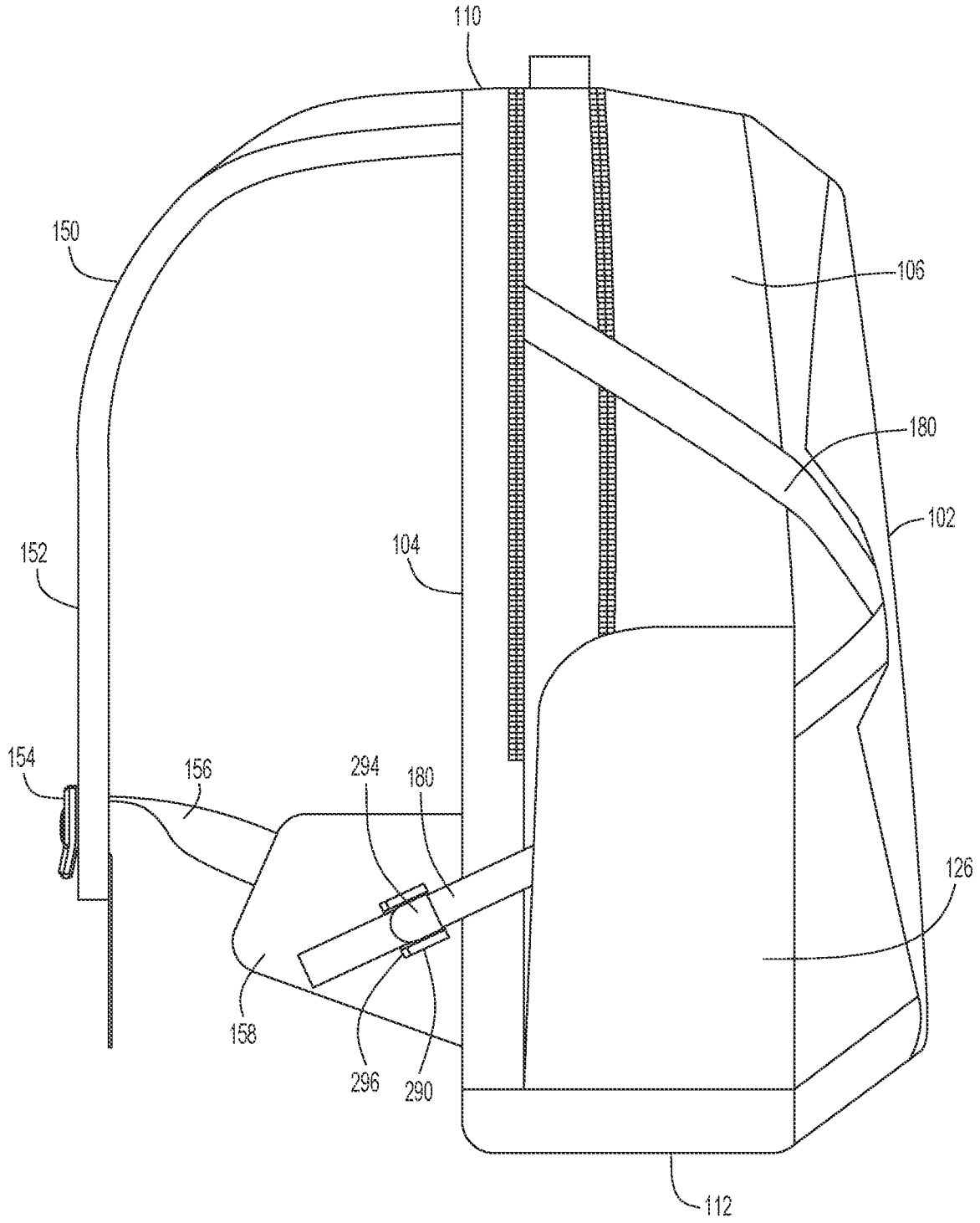
FIGS. 2A and 2B are opposing side views of the backpack of FIG. 1A.
Figure 2B:
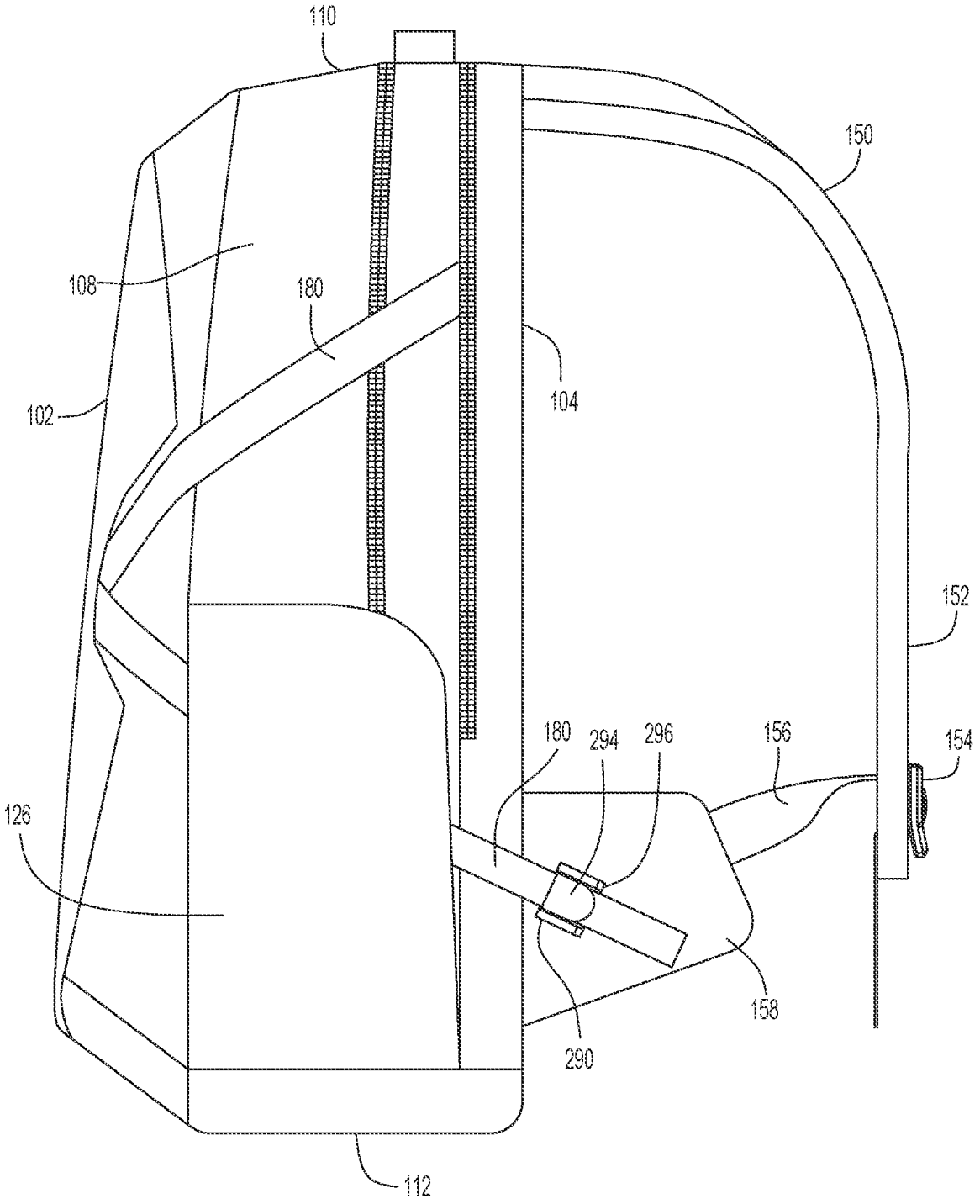

Referring to FIGS. 1A, 1B, 1C, 2A, 2B, 3 and 4, a backpack 100 comprises a main body or frame that is formed of one or more suitable materials and includes a front side 102 (FIG. 1A), a rear side 104 (FIG. 1B) that faces a user when the user is wearing the backpack as described herein, a top side 110 (FIG. 3), a bottom side 112 (FIG. 4), and two opposing sides (FIGS. 2A and 2B) that connect with the front and rear sides of the backpack. In particular, the backpack 100 includes a first lateral or left side 106 (FIG. 2A) and a second lateral or right side 108 (FIG. 2B). The front, rear, left, right, top and bottom sides 102, 104, 106, 108, 110, 112 of the backpack 100 combine to form a plurality of cavities, compartments or enclosures of varying sizes within the backpack for storing items (e.g., books, water bottles, shoes or other articles of apparel, electronic devices such as laptops and smart phones, etc.). The sides of the backpack combine to define a generally elongated (e.g., rectangular) shape in which a longer or lengthwise dimension of the backpack extends between the top side 110 and bottom side 112 (and thus a widthwise dimension of the backpack extends between the left side 106 and the right side 108, and a thickness dimension of the backpack extends between the front side 102 and the rear side 104).

Each of the sides of the backpack 100 can be formed of one or more panels (e.g., each side can be formed comprising a single, separate panel or two or more panels or, alternatively, two or more sides can be formed from one or more of the same panels). In embodiments in which the sides of the backpack are formed with two or more panels, the panels can be connected or secured to each other via any suitable connection (e.g., via a sewn or knitted seam, via lamination or any other suitable connection). Two or more sides of the backpack can include one or more openings that define a pocket, compartment or enclosure between two or more panels of the side and/or between two or more sides. A handle 111 (e.g., formed of a fabric panel, see FIG. 3) comprising a loop attached at each end to the top side 110 of the backpack 100 is also provided to facilitate easy lifting of the backpack when not being worn by the user.

The panels that form the sides of the backpack can be constructed of any suitably lightweight, flexible, water proof or water repellant and/or tear resistant materials including textiles or fabrics that are formed with any one or more suitable types of polymer materials, where the fabrics can further be formed in any suitable manner (e.g., any combinations of polymer fibers, yarns and/or filaments that form a fabric panel via knitting, weaving, nonwoven formation, etc.). Any suitable polymer materials can be used to form the fabric panels including, without limitation, polyamides (e.g., nylon materials), polyurethanes, polyolefins (e.g., polyethylenes, polypropylenes, etc.), polyesters (e.g., polyethylene terephthalate), polyacrylamides, polylactic acids, polyvinyl alcohol, and any variety of copolymers or combinations thereof. In addition, any one or more panels can be formed at least partially of elastomeric materials to provide a certain degree of elasticity to the fabric panel (e.g., to provide 2-way or 4-way stretch to a portion of the panel), where some non-limiting examples of elastic or stretchable fabric materials suitable for forming the outer fabric layer are fabrics comprising one or more combinations of polyester-polyurethane copolymers referred to generally as elastane (e.g., Spandex or Lycra materials).

Each panel forming a side or portion of a side of the backpack can further include one or more layers of material. For example, a panel that defines a portion of one or more sides of the backpack can include two or more layers, including an interior surface layer (i.e., an inward or enclosure facing layer) and an exterior surface layer (i.e., a layer that defines a portion of an exterior side of the backpack). One or more intermediate layers can also be provided within a panel (i.e., between the interior and exterior surface layers) so as to provide certain features for the panel. For example, one or more intermediate layers can comprise a foam material (e.g., polyurethane foam) to enhance the cushioning of the panel along one or more sides of the backpack. One or more interior layers can also include a hard and rigid material (e.g., a hard plastic, metal or other suitable material) to enhance the rigidity of the panel at certain locations of the backpack where it may be desired to provide greater stiffness or enhanced structural support.

Referring to FIG. 1A, the front side 102 of the backpack 102 includes a central slot or opening 120 that provides access to an enclosure or pocket disposed between panels of the front side 102. The enclosure or pocket accessible via the opening 120 is suitably sized to receive and retain items such as a water bottle, shoes, etc. The pocket slot or opening 120 extends at a central location of the front side 102 between the top end 110 and bottom end 112. A suitable fastener (e.g., a zipper) facilitates entry to and closure of the pocket via the opening 120. The opening 120 for the front pocket is centrally located between the sides 106, 108, and the front pocket is further centrally aligned along the front side 102 such that a water bottle or other item placed within the front pocket balances the weight centrally in relation the length and width dimensions of the backpack frame or main body.

Various other enclosures, compartments or pockets can also be provided for the backpack 100. The pockets can be suitably aligned in relation to the lengthwise axis of the backpack frame or main body so as to balance or distribute the weight of contents evenly within the backpack when each of the pockets is used.

Figure 3:
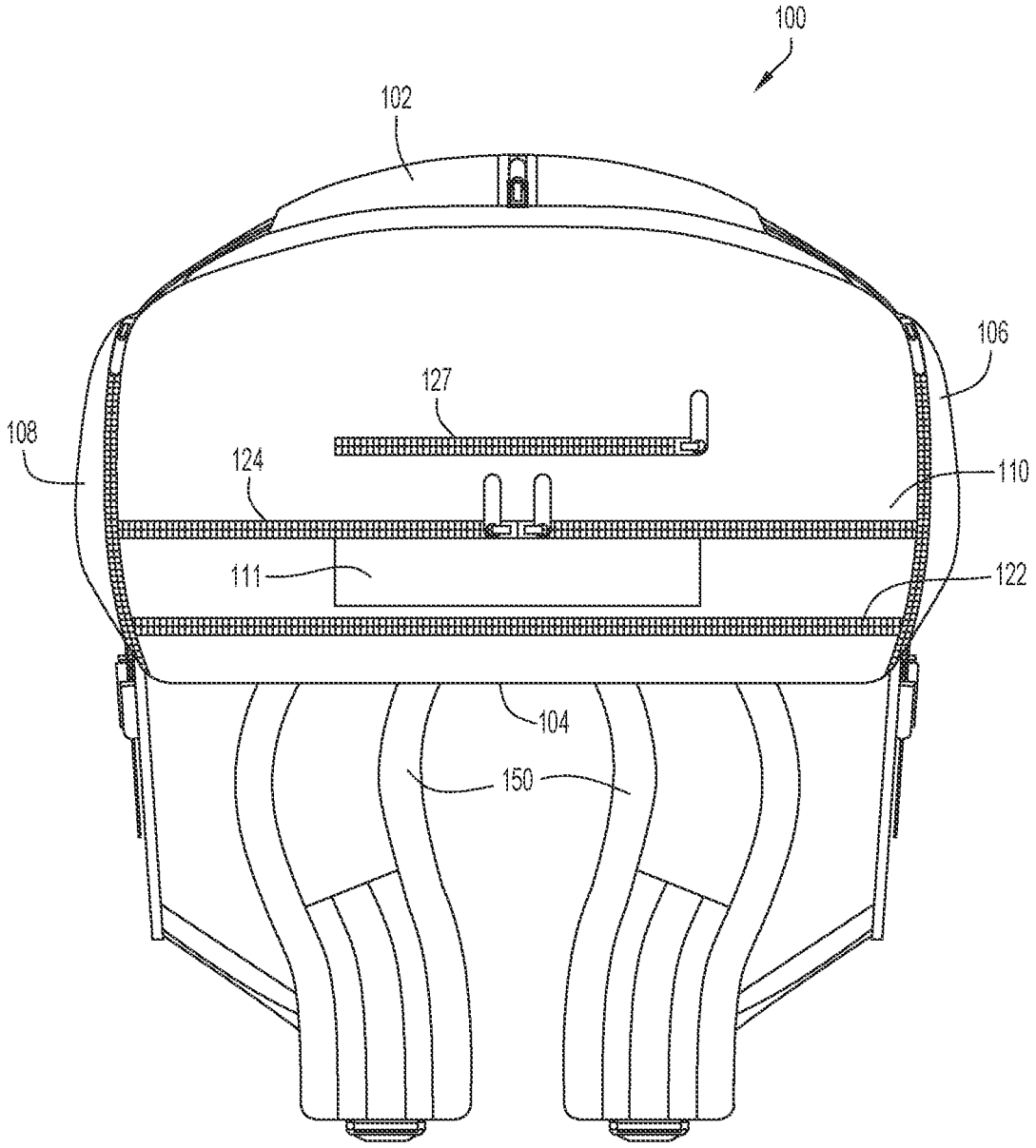
FIG. 3 is a top view of the backpack of FIG. 1A.
Figure 4:
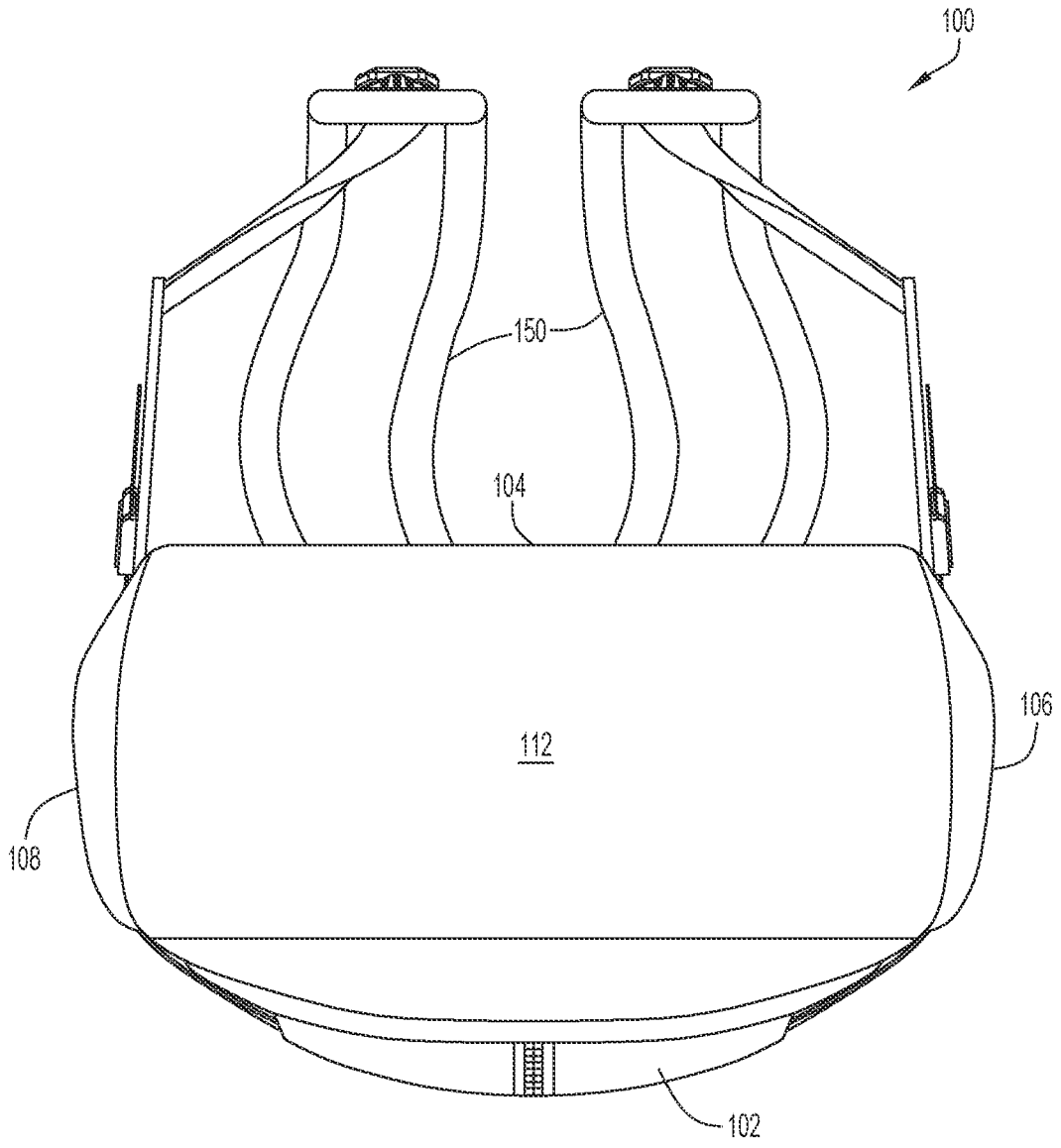
FIG. 4 is a bottom view of the backpack of FIG. 1A.

For example, referring to FIG. 3, three slots or openings are provided at the top side 110 of the backpack which provide access (e.g., via a zipper or other suitable fastener)

to a pair of central enclosures or pockets defined between the backpack front and rear sides 102, 104. In particular, a first central pocket opening 122 provides access to a first central pocket that is located between the rear side 104 of the backpack and an interior or mid-panel (not shown) disposed between the front side 102 and rear side 104 of the backpack. A second central pocket opening 124 provides access to a second central pocket that is located between the front side 102 and the mid-panel of the backpack. Each of the first and second central pockets can be suitably dimensioned to extend between top and bottom sides 110, 112 and between the left and right sides 106, 108 of the backpack so as to receive and retain items such as books, a laptop or other portable electronic devices, etc. In addition, each first and second central pockets can include further sub-compartments or pockets defined within the central pocket as well as other fastener structure (e.g., loop connectors to secure pens, pencils, a pointer or stylus, etc.). A third pocket opening 127 (located between the second pocket opening 124 and the front side 102) provides access to a third, smaller pocket (e.g., for storing a wallet, keys, or other similar items).

Each of the left side 106 and right side 108 includes a side enclosure, compartment, or pocket 126 defined between panels of the side and extending at or near the bottom side 112 to about a mid-region of the left or right side. The side pockets 126 are approximately the same or similar size and shape, and each includes an opening that is securable via a fastener such as a zipper and that provides access to the side pocket for storage of items such as mobile phones or other small portable electronic devices, wallets or items of similar sizes.

The rear side 104 of the backpack 100 includes a pair of shoulder straps 150, with each shoulder strap being aligned at or near a widthwise end of the rear side 104 and extending in a lengthwise direction of the backpack (i.e., between the top side 110 and the bottom side 112). One end of each shoulder strap 150 connects at a top location of the backpack at or near the top side 110 and/or a portion of the rear side 104 that is in close proximity with the top side 110. The other end of each shoulder strap 150 connects at a bottom location of the backpack at or near the bottom side 112 and/or a portion of the rear side 104 and left side 106 or right side 108 that is in close proximity with the bottom side 112. Each shoulder strap 150 comprises a plurality of sections, including a main shoulder strap portion or first section 152 that secures at an upper portion of the backpack rear side, and a second section comprising a bulk strap 156, a slip lock member 154 that couples the bulk strap with the first section, and an anchor pad 158 that secures the bulk strap to a lower portion of the rear end of the backpack. The first section 152 for each shoulder strap 150 has the same or substantially similar length which is fixed (non-adjustable). In contrast, the second sections of the shoulder straps include bulk straps 156 (which can be decoupled from the first sections 152) that are separately and independently adjustable to have variable lengths which in turn facilitates a separate and independent adjustability for the overall length of each backpack strap.

The sections and components of each shoulder strap 150 can also comprise panels formed of one or more layers of material that can be the same or similar materials as the layers forming panels for the main body of the backpack as described herein. For example, the panels defining the straps can be formed of one or more fabric materials including a plurality of layers with one or more intermediate foam layers provided between inner and outer fabric layers. Each shoulder strap 150 is suitably dimensioned to allow a user to place an arm through the gap between the strap and the main body or frame of the backpack 100 so as to wear the backpack with the straps extending over the shoulders of the user and the rear side 104 of the backpack aligned with and touching/engaging (or in close proximity with) the user's back. Thus, the shoulder straps 150 facilitate support of the backpack 100 by the shoulders of the user wearing the backpack.

As previously noted herein, each shoulder strap 150 includes a first section or first member 152 that connects at an upper or top end to the backpack rear side 104 at or near the connection between the backpack rear side 104 and the backpack top side 110 (and also in close proximity to the left side 106 or right side 108 of the backpack). The first section 152 can comprise a plurality of panels formed of a fabric or other suitably flexible material and further comprising a softer (e.g., foam) material disposed between the panels. At least the top portions of the first sections 152 engage with the user's shoulders when the backpack is worn, thus providing a cushioning engagement with the user's body when the backpack is worn and carries a weighted load (e.g., the backpack is filled with one or more items). Each first section 152 has the same or substantially similar length and extends substantially the length of the terminates at a lower or bottom free end that is not directly connected to the rear side 104 or any other side of the backpack.

Located at the bottom free end of each shoulder strap first section 152 is a second section that comprises a slip lock member 154 formed of a suitably hard/non-flexible material (i.e., a harder material in relation to the material(s) forming the first section 152) such as plastic or metal. The slip lock members 154 include portions that are secured between the panels of the first sections 152 so as to extend through the first sections of the straps 150. For example, each slip lock member 154 can be partially embedded between interior and exterior panel portions of the corresponding strap first section 152 such that an outwardly facing surface of the slip lock member that faces away from the rear side 104 is generally flush or coplanar with the outwardly facing surface of the first section 152.

Referring to FIGS. 1B, 5 and 6, 7, 8A, 8B, 9A and 9B, and as described in further detail herein, each slip lock member 154 has a generally rectangular configuration that includes a first or upper portion 160 and a second or lower portion 162. Each of the upper and lower portions of the slip lock member are flat and plate-like in configuration, where the lower portion 162 extends at a slight outward angle from the upper portion 160 (i.e., angled away the strap first section 152 when the slip lock member is connected with the first section). As can be seen best in FIGS. 9A and 9B, the lower portion 162 extends outward and away from an outer surface of the upper portion 160 (and also slightly outward and away from the first section 152 when the slip lock member is connected with the first section) such that a central lengthwise axis 163 of the lower portion extends at an angle A from a central lengthwise axis 164 of the upper portion that is at least 5° but is less than 45° (e.g., no greater than 30°, or no greater than 20°). The lower portion 162 also tapers slightly in its width or dimension transverse the lengthwise dimension of the slip lock member 154 as it extends from the upper portion 160 to the terminal end of the lower portion. This configuration provides an enhanced gripping or engagement area for the slip lock member (e.g., at the lower portion) during use when a user holds part of the slip lock member and pulls the bulk strap to make adjustments to each shoulder strap.

The upper portion 160 of the slip lock member 154 includes two elongated slots 204, 206 extending generally parallel with each other and in a direction transverse the lengthwise dimension of the first section 152. In an example embodiment, the upper portion 160 of the slip lock member 154 includes a generally rectangular cutout section or window 205 through the thickness of slip lock member, where a crossbar 202 is provided within and extends across to connect with edges of the window so as to define the two elongated slots 204, 206 on either side of the crossbar 202.

Figure 7:
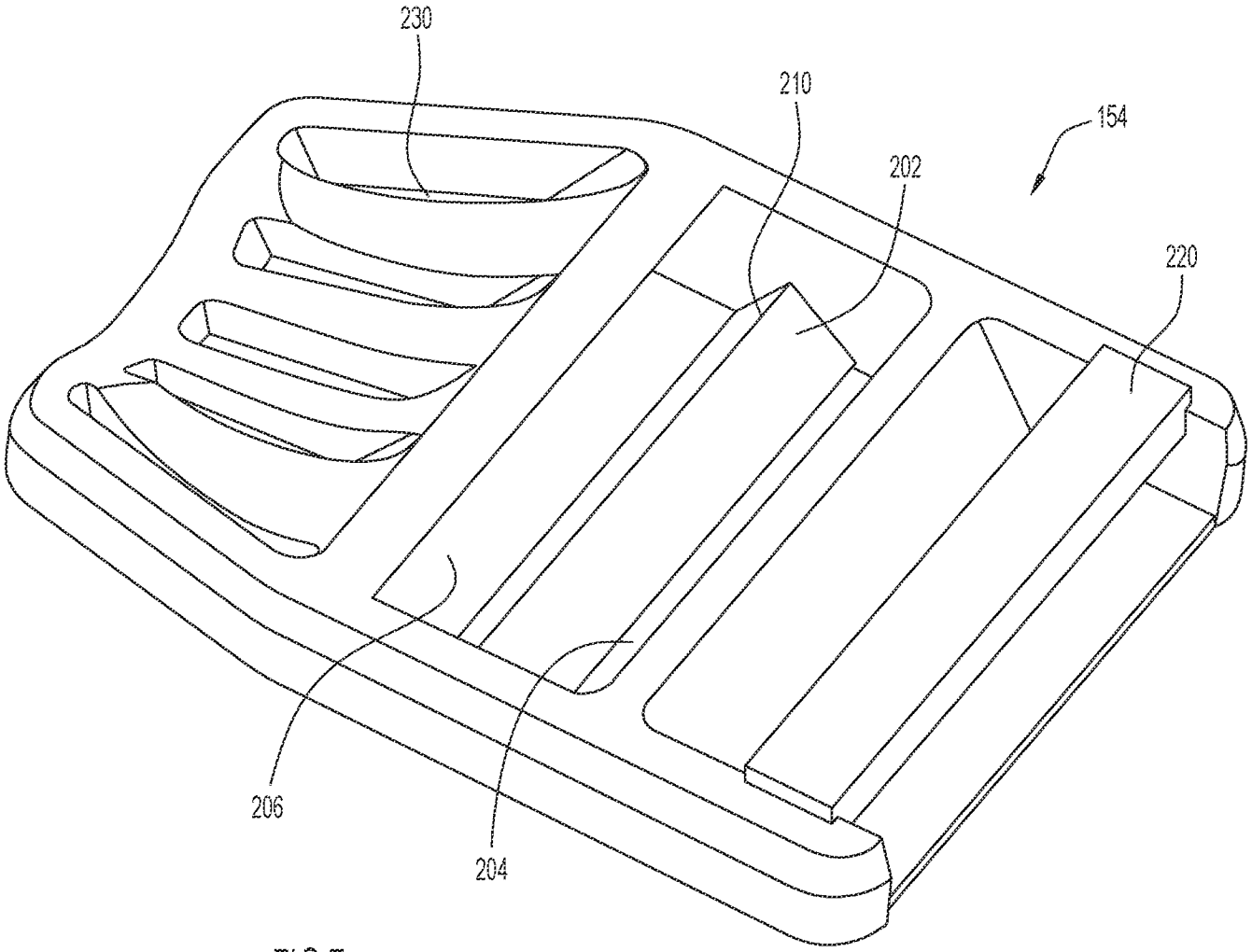
FIG. 7 is a rear view in perspective of the slip lock member of FIG. 6.
Figure 8B:
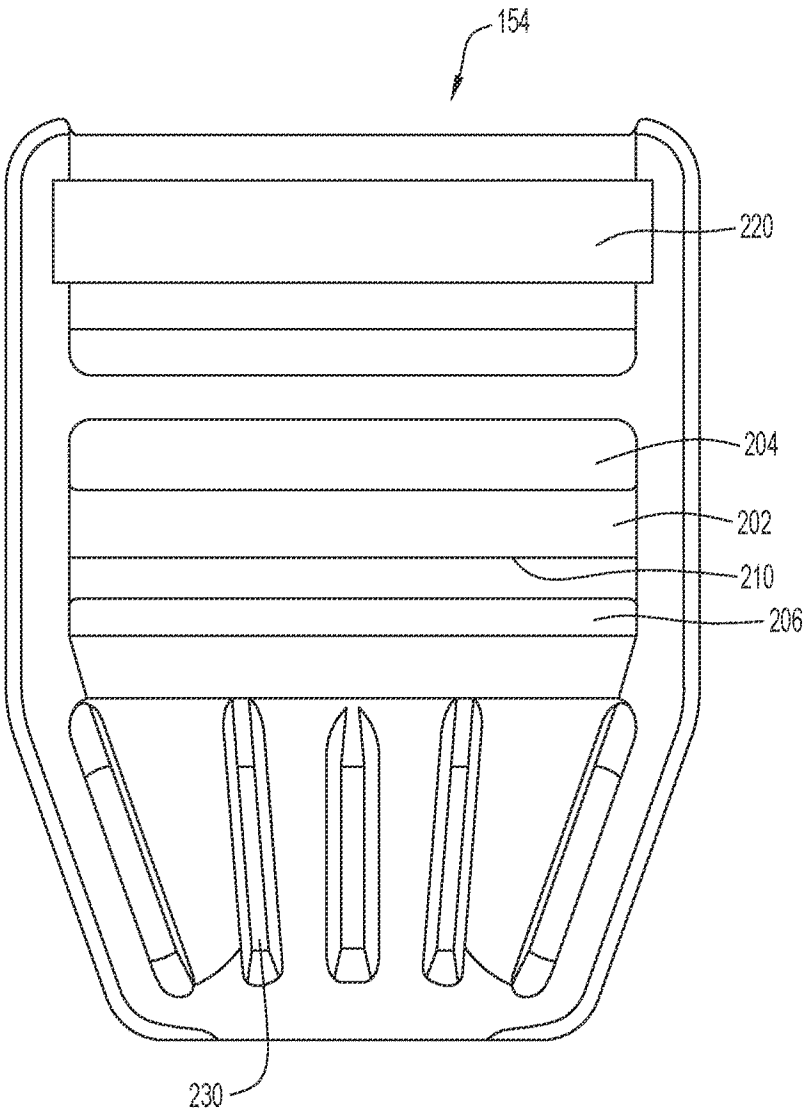
FIGS. 8A and 8B are respective front and rear views in plan of the slip lock member of FIG. 6.
Figure 8A:
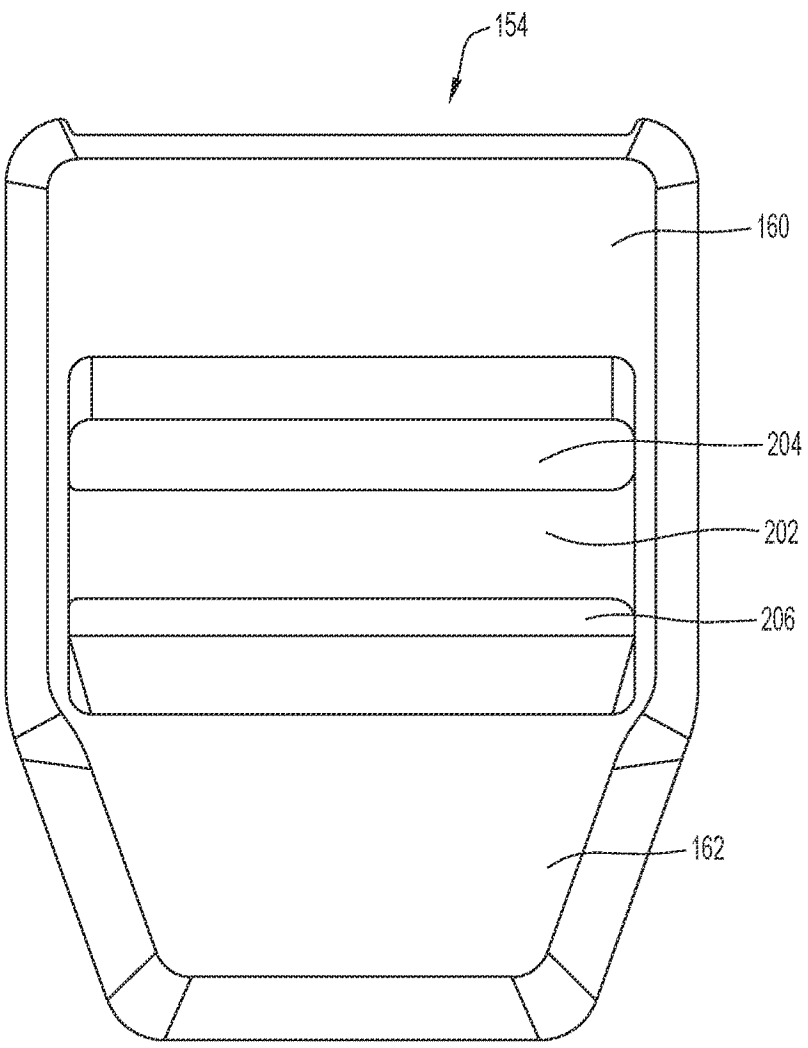
Figure 9B:
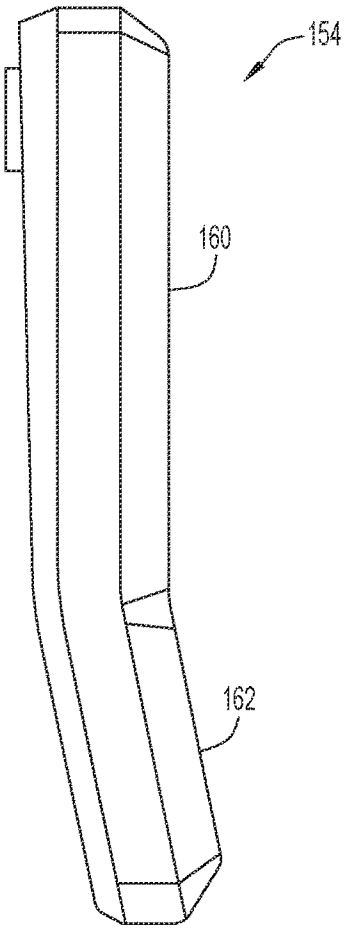
FIGS. 9A and 9B are opposing side views of the slip lock member of FIG. 6.
Figure 9A:
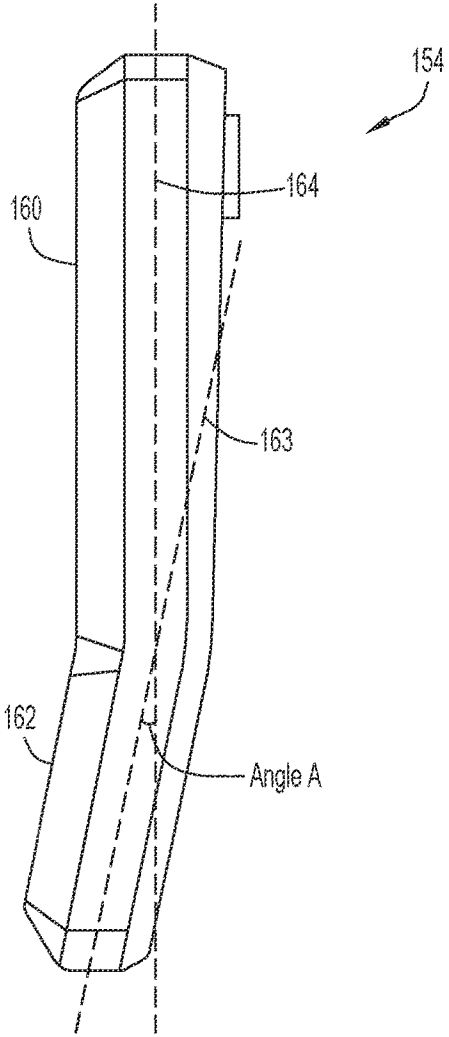

Additional structure is provided along the rear side of the slip lock member 154 (as best shown in FIGS. 7 and 8B). The upper portion 160 of the slip lock member at the rear side includes an indentation with a second crossbar 220 (i.e., located above the crossbar 202) that extends the width of the slip lock member. This second crossbar 220 can enhance securing of the slip lock member 154 to the first section 152 of the corresponding strap. The lower portion 162 of the slip lock member includes a plurality of lengthwise extending indentations or grooves 230 (i.e., the grooves 230 extend in a direction of the lengthwise dimension of the slip lock member 154). The grooves 230 can also enhance securing of the slip lock member to the strap first section. In addition, the grooves can be configured to facilitate a slight pivotal movement of the lower portion 162 in relation to the upper portion 160 of the slip lock member to enhance securing and/or release of a bulk strap 156 that is threaded through the slip lock member in the manner described herein.

The second section of each shoulder strap 150 further comprises an elongated strip member or bulk strap 156 that releasably connects the first section 152, via the slip lock member 154, to a lower portion of the backpack 100. While the first sections of the backpack straps have fixed lengths, the bulk straps of the second sections of the backpack straps have adjustable lengths. In particular, the elongated bulk straps 156 facilitate connections of the bottom free ends of the shoulder strap first sections 152 to the rear side 104 at or near the bottom side 112 and corresponding left side 106 or right side 108 of the backpack 100. Each bulk strap 156 extends or is laced at a free end through the slots 204, 206 and around the crossbar 202 of a corresponding slip lock member 154 so as to form a releasable locking buckle-like connection between bulk strap and slip lock member. The other end of each bulk strap 156 is connected (e.g., via stitching or any other suitable connection) to an anchor pad 158 extending from the rear side 104 at rear side edge locations of a corresponding left or right side 106, 108 and bottom side 112. Each anchor pad 158 comprises a thin flexible material comprising, e.g., one or more fabric panels and is generally rectangular in configuration and connects (e.g., via stitching or in any other suitable manner) at one end from the rear side 104, where the anchor pad further extends outward and away from the rear side 104 to a free end that connects with the end of the corresponding bulk strap 156.

Each bulk strap 156 comprises a suitably flexible webbing material (e.g., formed of textile comprising polypropylene, nylon, etc.) that facilitates slidable movement in one direction through the slip lock member 154 to which it is engaged while also locking in place with the slip lock member during use. The configuration of the slip lock member 154 and bulk strap 156 for each buckle bulk strap connection results in a tightening or cinching of the bulk strap in that the bulk strap can be easily pulled through the slots 204, 206 of the slip lock member 154 so as to increase a length of a portion of the bulk strap that extends through the slip lock member to the bulk strap free end while movement of the bulk strap through the slip lock member in the opposing direction (i.e., to decrease the length of the portion of the bulk strap extending through the slip lock member to its free end) is substantially minimized or prevented.

For example, during initial connection of each bulk strap to a corresponding slip lock member, the free end of each bulk strap 156 can be initially guided or "threaded" through the slots 204, 206 of the corresponding slip lock member 156 by first inserting the bulk strap free end from the inner facing panel surface (i.e., surface that faces the rear side 104) of the strap first section 152 through the upper first slot 204, over the crossbar 202 and then back through the lower second slot 206 of the slip lock member so as to provide a bulk strap portion having a selected length that extends from the lower second slot/slip lock member to the bulk strap free end. The free end of each bulk strap can be formed so as to have a greater thickness than other portions of the bulk strap so as to prevent pulling of the bulk strap free end through the slots in the direction that opposes the direction in which the bulk strap was guided or "threaded" through the slots. In an example embodiment, the free end of each bulk strap can be folded over upon itself and secured to itself (e.g., via stitching) thereby doubling the thickness of the bulk strap at its free end.

The crossbar 202 of the slip lock member 154 can include tapered or beveled rearward extending walls located between the first slot 204 and second slot 206 and that meet at a rear edge 210 (i.e., the edge of the crossbar that faces the strap first section 152, see FIGS. 7 and 8B). These tapered walls leading to the rear edge 210 facilitate a tightening/cinching and locking connection for the buckle bulk strap connection by permitting movement of the bulk strap through the slots in one direction while preventing or substantially minimizing movement of the bulk strap through the slots in the opposing direction when the backpack is worn. In particular, the tightening or cinching connection facilitates easy pulling of the bulk strap free end away from the slip lock member to increase the length of the bulk strap portion from the free end to the slip lock member while preventing or substantially minimizing pulling of the bulk strap in the other direction (i.e., drawing the bulk strap free end closer toward the slip lock member). The cinching of the bulk strap 156 with the slip lock member 154 by pulling the bulk strap free end away from the slip lock member further decreases a length of the portion of the bulk strap located between the slip lock member and the anchor pad 158. During use, when the backpack is worn by a user, the tightening/cinching and locking connection maintains the alignment of each bulk strap with its corresponding slip lock member with substantially no sliding movement of the bulk strap through the slots of the slip lock member.

The bulk strap connection can be unlocked by pushing the portion of the bulk strap including its free end back toward the lower slot 206 to create a loop in the bulk strap that extends between and outward/away from the two slots of the slip lock member. This facilitates a release of the cinching/locking connection between slip lock member and bulk strap, allowing the bulk strap to be pulled through the upper first slot and away from the slip lock member and thus increasing the length of the bulk strap portion between the slip lock member 154 and anchor pad 158.

Each bulk strap 156 further includes indicia provided on the outward facing side of the bulk strap (i.e., the bulk strap side facing away from the backpack rear side 104 when the bulk strap free end extends through the slip lock member). The indicia comprises any suitable markings or marks that can be applied in any suitable manner (e.g., via printing, stitched patterns, etc.) to the bulk strap outward facing surface at selected distances from each other to function as a scale or a series of gradations along the bulk strap from its free end to a selected length along the bulk strap. In the example embodiments (see, e.g., FIGS. 1B and 5), the indicia comprises a numeric series of markings 250 including a line extending across the bulk strap surface in a direction perpendicular to its length and a numeric series (series of sequential numbers) ordered, e.g., as 0, 1, 2, 3, 4, 5, 6, . . . X, where the first number 0 begins at or near the free end of the bulk strap and the last number X is located closest to the bulk strap end connecting with the anchor pad 158. Each marking (e.g., the distance between lines associated with numbers 0 to 1, 1 to 2, 2 to 3, etc.) is equidistant from its previous and successive marking, thus providing a measured scale that correlates with the length of bulk strap located between the slip lock member and the anchor pad and therefore the size of the entire loop of the shoulder strap 150 (i.e., distance of entire shoulder strap between its connections with the backpack rear side 104) as defined by first section 152, anchor pad 158 and portion of bulk strap 156 between slip lock member 154 and anchor pad.

Any suitable selection of numbers or other gradations/markings can be provided, which may represent a height of a user or any other indication that correlates with length of the bulk strap portion between anchor pad and slip lock member. For example, with numeric series of numbers, the numbers can start at 0 and increase sequentially to a maximum value X that can be any suitable number (e.g., 5, 10, 15, 20, 25, 30, etc.). While the markings described in the examples comprise numbers, any other suitable markings comprising alphanumeric characters (e.g., A, B, C, D, E, etc., or A1, A2, . . . , B1, B2, . . . , etc.), colors (e.g., spectrum of colors of various gradations), or other symbols or icons (e.g., stick figures of varying sizes) can also be provided along the bulk straps to designate a specific size for the entire shoulder strap loop.

Figure 5:
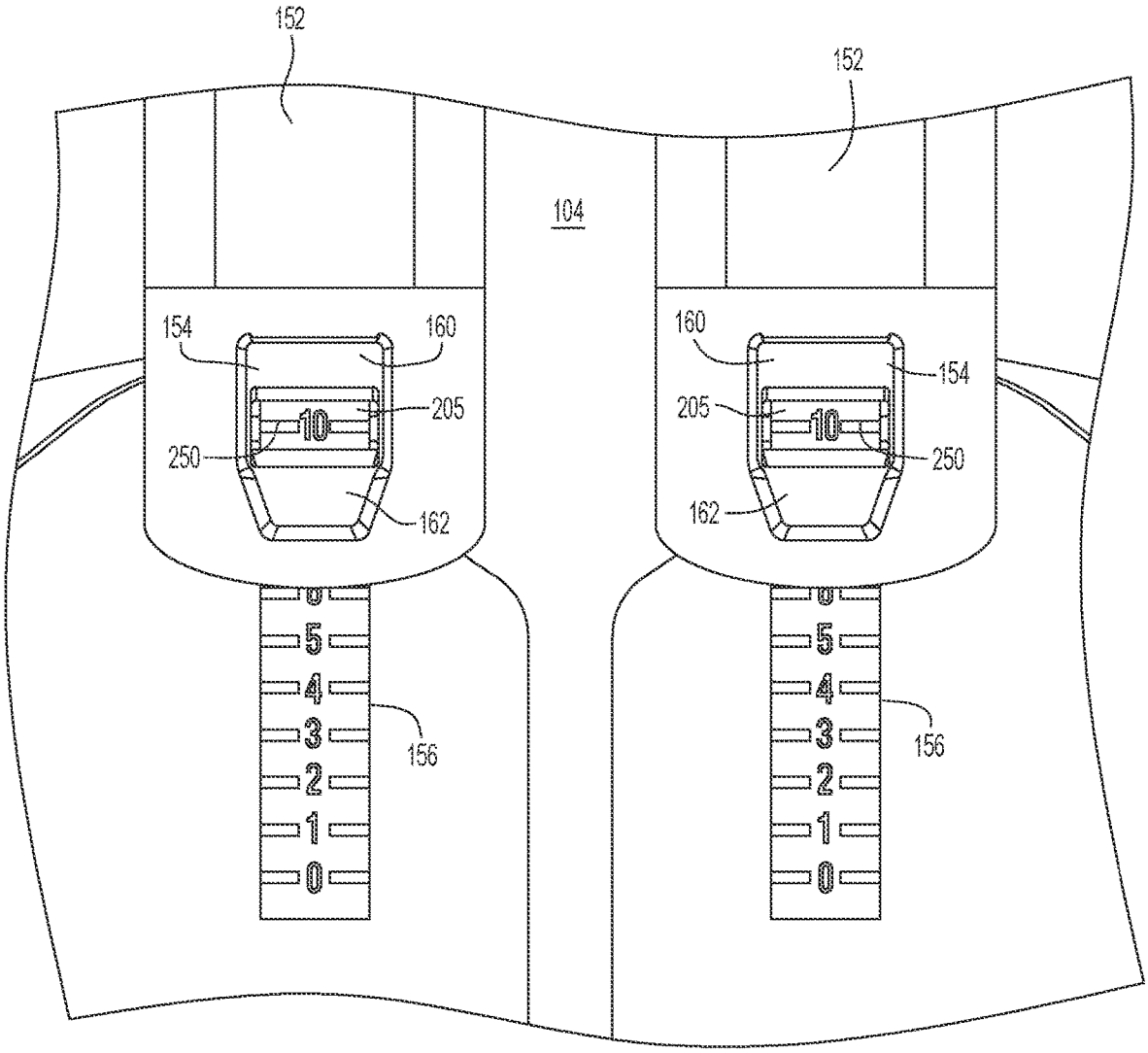
FIG. 5 is an enlarged rear view of the backpack of FIG. 1A, showing in greater detail backpack leveling features integrated with each shoulder strap of the backpack.
Figure 6:
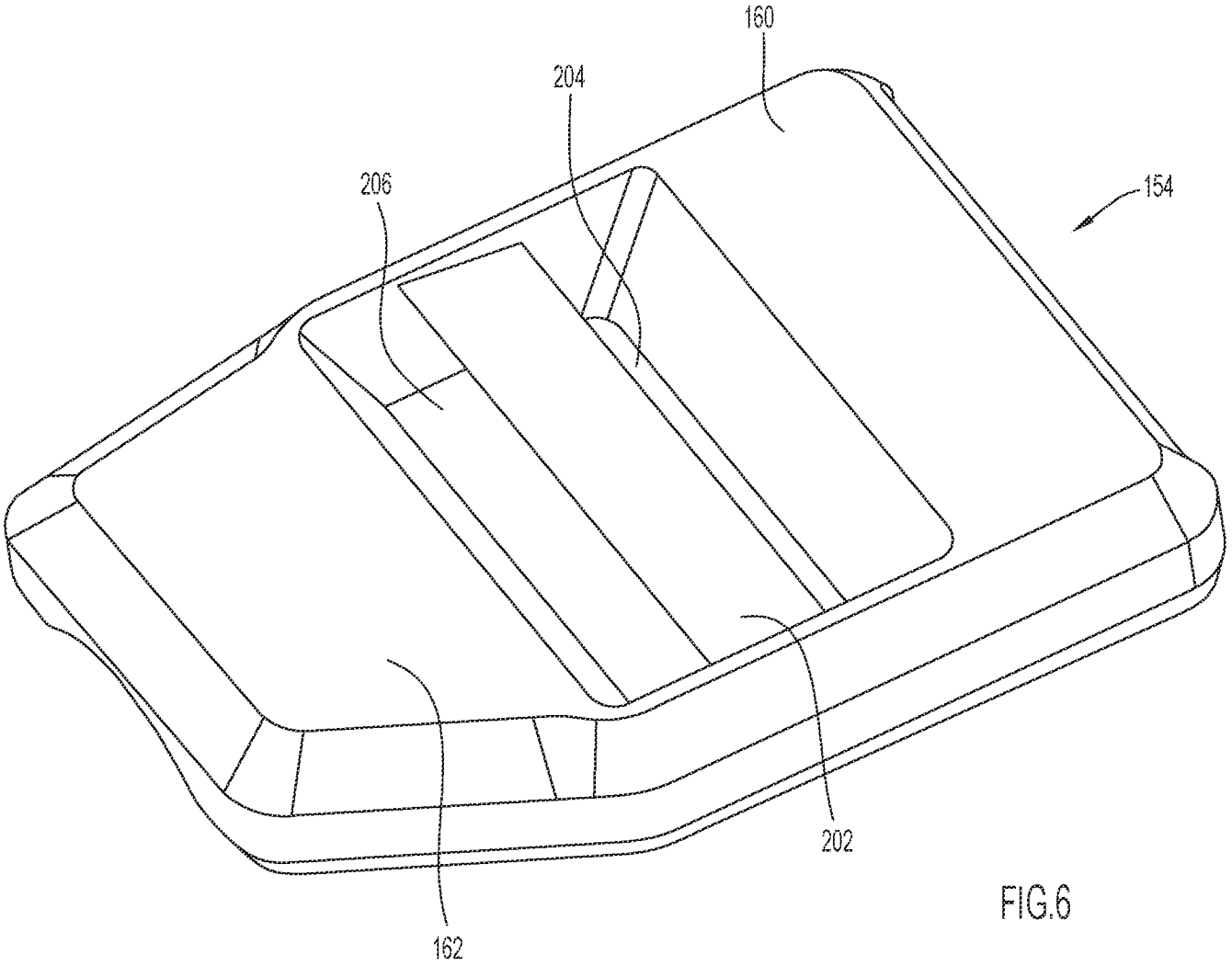
FIG. 6 is a front view in perspective of the slip lock member (in isolation) that connects with a backpack strap to facilitate leveling of each backpack strap in relation to the other backpack strap.

The size of each mark in the gradation or scale of markings along each bulk strap is suitably dimensioned so as to fit and be clearly visible within the window 205 of its corresponding slip lock member 154. In particular (and as shown in FIG. 5), a small portion of each bulk strap 156 is exposed in the opening or window of its corresponding slip lock member 154 when the bulk strap is guided/threaded through the upper first slot 204 and lower second slot 206 of the slip lock member. The bulk strap can be adjusted (e.g., by pulling on the bulk strap free end) so as to precisely position or align a marking (e.g., "-10-" as shown in FIGS. 1B and 5) to be visible within the slip lock member window 205.

The buckle-like, bulk strap connection that locks each bulk strap 156 in position in relation to the lower end of the shoulder strap first section 152 and slip lock member 154, in combination with the markings provided along the bulk straps, provides a leveling feature for the backpack 100 that enables the user to adjust the bulk straps precisely so that the length of the second section 156 for each shoulder strap 150 (i.e., the strap portion between the end of the shoulder strap first section 152 and the anchor pad 158 at each of the left and right sides of the backpack) is substantially identical. For example, each bulk strap can be adjusted by tightening or cinching the bulk straps in relation to the slip lock members so that the markings 250 provided within the windows of the slip lock members are the same. This ensures the same or substantially similar alignment and thus leveling of the shoulder strap lengths along each of the lengthwise sides of the backpack, which results in distributing or balancing the weight of the backpack and its contents uniformly across the user's shoulders and back.

Further, in embodiments in which the weight in the backpack may not be evenly distributed, the backpack leveling feature allows for an adjustment in the overall length of one of the shoulder straps that differs from the other shoulder strap so as to account for the weight imbalance in the backpack by leveling the alignment of the backpack along the user's back and shoulders. For example, in an embodiment in which a water bottle or other contents may be provided in the side pocket 126 along the left side 106 of the backpack 100 but no contents are provided in the side pocket 126 of the right side 108, the bulk straps 156 can be adjusted so that different marks 250 are provided within the windows 205 of the slip lock members 154 with the result that the overall shoulder strap lengths differ (i.e., the overall length of right shoulder strap differs from the overall length of left shoulder strap to account for water bottle in the left side pocket).

Additional backpack shoulder strap structure can be provided to enhance the leveling features of the shoulder straps. For example, a pair of cross-wise straps (not shown) can be provided, where each cross-wise strap extends transversely from a respective shoulder strap first section 152 toward the other cross-wise strap and the two cross-wise straps connect to each other at their free ends via any suitable fastener engagement (e.g., via a male-to-female structural or buckle connection). In use, the cross-wise straps can be connected to each other when the backpack 100 is worn by the user so as to maintain or enhance the leveling of the shoulder straps 150 as well as uniform engagement with and support of the backpack by the user's shoulders.

Figure 10:
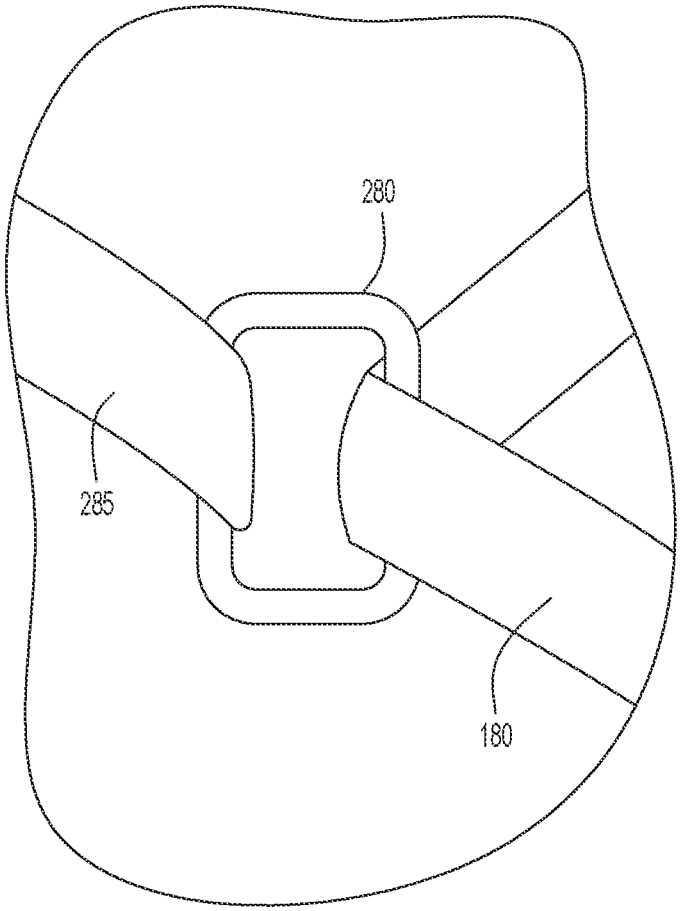
FIG. 10 is an enlarged view of a portion of the front side of the backpack of FIG. 1A, depicting a sliding anchor that supports a side support strap at the front side of the backpack.

A pair of side support strap members 180 can also be provided at each lengthwise side of the backpack 100 to enhance leveling support by the shoulder straps 150 on the user's shoulders and back when the backpack is worn by the user. The side support strap members can be constructed of the same or similar materials as the bulk straps and comprise a suitably flexible webbing material (e.g., formed of textile comprising polypropylene, nylon, etc.) that facilitates slidable movement of the side support straps in relation to a slidable anchor member or clip 280 as described herein (also shown in FIG. 10). Each side support strap member 180 extends between the front side 102 (along the left side 106 or right side 108) and the rear side 104 of the backpack 100. An upper first end of each strap member 180 connects at or near an upper portion of the rear side 104 at a side edge between the rear side 104 and corresponding left or right side 106, 108 at a location slightly below the top of the backpack. The strap member 180 continues from the connection at the upper first end, extending around the left or right side 106, 108 of the backpack to a central portion of the front side 102 of the backpack.

A pair of slidable anchor members or clips 280 are secured at the central portion of the front side 102 in close proximity to a corresponding lengthwise (left or right) side of the backpack. Each anchor clip 280 can be disposed within a small pocket (indicated at dashed locations 275 along the front side 102) accessible via a slot that separates a front, outermost panel 270 from an underlying panel of the front side 102 (see FIGS. 1A and 10, each anchor clip 280 is located underneath the outermost panel 270 at a location 275). Each slidable anchor clip 280 comprises a hard (e.g., plastic or metal) material including a cut-out section or window extending through the anchor member, where the anchor clip 280 secures at one side to the backpack front side (e.g., via a strap 285 that extends through the window of the anchor member and secured at each strap end to the underlying panel of the backpack front side). Each strap member 180 extends through the window of the anchor clip 280 and continues around the corresponding left or right side 106, 108 and loops back to the rear side 104 near the lower side of the backpack. As shown, e.g., in FIGS. 2A and 2B, each strap member 180 can further be guided through a channel defined between panels of each of the left and right sides 106, 108 of the backpack so as to extend behind the corresponding side pocket 126. Thus, each strap member extends from the front side 102 through the anchor member 280, around the left or right side of the backpack and behind its corresponding side pocket 126, and back to the rear side 104. Each anchor clip 280 permits easy slidable movements of the strap members 180 when pulled in either direction in relation the clip 280. Thus, unlike the slip lock members 154, the anchor clips 280 do not provide a cinching or locking function for the strap members 180.

Referring to FIGS. 2A and 2B, a locking clip 290 is also secured to each anchor pad 158. Each locking clip 290 is configured to receive a corresponding strap member 180 that extends from or loops around an anchor clip 280 and further extends back around the left or right side 106, 108 and back to a lower portion of the rear side 104 of the backpack. Each side strap member 180 extends through a corresponding locking clip 290 to its lower terminal or free end. Each locking clip 290 includes a base member 294 secured to the anchor pad 158 and a locking tab 296 that is pivotally connected to the base member 294. In an example embodiment, biasing structure (e.g., one or more spring elements) can be provided in the pivotal connection between the base member 294 and locking tab 296 that biases the locking tab toward the base member. Each strap member 180 is directed or "threaded" between the base member 294 and the locking tab 296 of the corresponding locking clip 290. The locking tab 296 can include a rear (i.e., strap member facing) engagement surface that is suitably contoured (e.g., includes a roughened surface) to press against/engage with the strap member 180 and prevent its sliding movement and thus locking the strap member in a fixed position in relation to the locking clip 290 and the anchor pad 158 when a free end of the locking tab is moved to a furthest downward and closed or locked position toward the base member 294. When the locking tab 296 is pivoted to an open position such that its free end is angled away from the base member 294 and its rear engagement surface is not engaged with the strap member 180, the strap member 180 can move or slide freely in relation to the locking clip 290.

The side support strap member configuration allows the user, when wearing the backpack and with the locking tabs 296 of the locking clips 290 being in an open position, to pull at or near the free ends of the strap members 180 so as to extend the lengths of the portions of the strap members extending from the locking clips 290 to their free ends. This provides a tightening or cinching effect for the side support strap members, pulling the front side 102 and left and right sides 106, 108 of the backpack 100 closer inward toward the rear side 104 and the user's back and shoulders when the backpack is worn by the user. When a desired amount of tightening/cinching is achieved, the locking tabs 296 can be moved to their closed and locked positions, preventing sliding movement of the side support strap members 180 in relation to the locking clips 290 in order to retain the tightening/cinching effect as long as it is desired by the user.

The combination of features of the backpack 100 facilitate a substantially uniform distribution of weight of the backpack across the user's shoulders and back and/or a leveling of the backpack (e.g., lengthwise dimension of the backpack main body is generally parallel with the height dimension of the user) against the user's shoulders when the backpack is worn (i.e., shoulder straps provided around shoulder of the user with backpack rear side 104 facing the user's back). The strap leveling feature allows the user to adjust the overall strap lengths of both straps 150 so as to be the same or substantially equal in length by tightening/cinching the bulk straps 156 so that the indicia or markings 250 on the bulk straps 156 (as displayed within the window 205 of each slip lock member 154) are the same. Alternatively, if the weight is not distributed evenly within the backpack, the overall lengths of the straps can also be adjusted to maintain a level positioning of the backpack against the user's body. This provides a leveling effect for the backpack against the user's shoulders and back, where a lengthwise dimension of the backpack along its central frame or main body is generally parallel with the height dimension of the user.

The location of the bulk straps, being positioned near the lower ends of the first sections of the backpack straps, allow for each adjustment of a user when the backpack is being worn. In particular, when the backpack is being worn, the free ends of the bulk straps are easily accessible by the user, and the user can simply and easily grip each of the bulk straps proximate their free ends and pull in order to cinch or tighten the bulk straps and adjust the alignment of (e.g., level) the backpack in relation to the user's back and shoulders. Similarly, the side strap members are also easily accessible for adjusting (e.g., tightening or cinching) by the user when the backpack is being worn.

Further, the tightening/cinching features of the side support strap members 180 (which extend from the rear side 104, to the front side 102, and back to the rear side 104 of the backpack) are configured to bring the backpack and its contents closer to the user's back when worn, thus bringing the weight or load of the backpack closer to the center of mass of the user's body.

The combination of tightening or cinching the bulk straps 156 via the slip lock members 154 and the tightening or cinching of the side support strap members 180 via the locking clips 290 functions to provide a combined tightening or cinching of the backpack front side 102, rear side 104 and left and right sides 106, 108 centrally and toward each other so as to pull and slightly compress the backpack sides against items placed within pockets or enclosures of the backpack. In particular, the bulk straps and side support strap members are independently and selectively adjustable to tighten and pull the front side toward the rear side (and left side toward right side) of the main portion of the backpack when the backpack is worn by a user. This condenses the spacing within compartments of the backpack in which items are stored as well as minimizing shifting of items during use of the backpack when worn by a user.

The locations and alignment of pockets (e.g., the two side pockets 126 aligned at similar locations along the left side 106 and right side 108 of the backpack, as well as the central pocket accessible via opening 120 along the front side 102) are also configured to provide a general symmetry for loading of contents within the backpack in relation to the lengthwise center of the backpack so as to facilitate a generally uniform distribution of weight throughout the backpack. This in turn facilitates a more even distribution of the backpack weight on the user's shoulders and back during use of the backpack.

Thus, the features described herein enhance the wearability and use of the backpack, allowing the user to selectively and properly adjust the shoulder straps so as to level the backpack and its contents, distributing the weight within the backpack evenly along the user's back and shoulders. The features described herein also effectively facilitate tightening or cinching the sides (e.g., front and rear sides) of backpack with its contents together and against the user's back and shoulders during use.

While the invention has been described in detail and with reference to specific embodiments thereof, it will be apparent to one skilled in the art that various changes and modifications can be made therein without departing from the spirit and scope thereof.

For example, any suitable tightening or cinching clip structure can be provided to effectively tighten the bulk straps of the shoulder straps and the side strap members against the backpack. The backpack can include any suitable number, sizes and locations for pockets or enclosures that are accessible for placement and storage of items during use of the backpack. Any suitable types of materials and any suitable number of material layers can be used to form any number of panels that define one or more sides of the backpack. Further, any suitable marking indicia can be utilized to facilitate leveling of the backpack straps in relation to the user's shoulders via the bulk straps.

It is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed:

1. A backpack comprising:

a main body including a front side and a rear side;

a pair of shoulder straps, each shoulder strap extending from a first fixed end at an upper portion of the rear side to a second free end; and a shoulder strap leveling structure coupled with each of the shoulder straps, wherein each shoulder strap leveling structure is coupled with a corresponding shoulder strap and comprises:

a slip lock member disposed along a portion of the corresponding shoulder strap at the second free end of the corresponding shoulder strap, wherein each slip lock member is at least partially embedded within the second free end of the corresponding shoulder strap and includes a first flat portion extending to a second flat portion, the first flat portion including a window with a crossbar extending across the window that separates the window into a first slot and a second slot such that the crossbar and each of the first slot and the second slot are disposed within the first flat portion, and the second flat portion extending at an angle of less than 45° outward and away from the first flat portion; and a bulk strap including a first end coupled with the rear side of the backpack and a second free end that extends from behind the corresponding shoulder strap and through the first slot, over the crossbar and through the second slot of the slip lock member of the corresponding shoulder strap;

wherein each bulk strap includes a plurality of markings arranged along a length dimension of the bulk strap, and the window of each slip lock member exposes a portion of the corresponding bulk strap that extends through the first slot, over the crossbar and through the second slot of the slip lock member such that a single marking of the plurality of markings is visible at the window when the bulk strap of the corresponding shoulder strap is moved to different positions in relation to the slip lock member.

2. The backpack of claim 1, wherein each bulk strap is independently adjustable to adjust an alignment of the backpack in relation to shoulders of a user when the backpack is worn by the user.

3. The backpack of claim 1, wherein the markings comprise a series of sequential numbers spaced from each other along the length dimension of each bulk strap.

4. The backpack of claim 1, further comprising a first anchor pad extending from the rear side at or near a first lengthwise side edge of the backpack and a second anchor pad extending from the rear side at or near a second lengthwise side edge of the backpack, and each bulk strap is affixed via stitching to one of the first and second anchor pads at the first end of the bulk strap.

5. The backpack of claim 4, further comprising a pair of side support straps, wherein each side support strap includes a first end connected to the rear side and an upper portion of the backpack and a second end, each side support strap extends from the first end of the side support strap to couple with an anchor structure at the front side of the backpack and further extends from the anchor structure back to the rear side to couple with support structure at the rear side and a lower portion of the backpack, and the anchor structure is disposed within a pocket defined between a front, outermost panel and an underlying panel at the front side of the backpack.

6. The backpack of claim 5, wherein the support structure comprises a pair of locking clips, wherein each locking clip is secured to one of the first anchor pad and the second anchor pad, and the second end of each side support strap extends through so as to movably couple the side support strap with one of the locking clips.

7. The backpack of claim 6, wherein the bulk straps and the side support straps are independently and selectively adjustable to tighten and pull the front side toward the rear side of the main portion when the backpack is worn by a user.

8. A backpack comprising:

a main body including a front side and a rear side;

a shoulder strap comprising:

a first section that connects at a first end to an upper portion of the rear side, the first section further including a second free end that opposes the first end; and a second section comprising a slip lock member integrated with the first section at the second free end of the first section, and a bulk strap including a second free end that releasably and slidably couples with the slip lock member and a first end that connects at a lower portion of the rear side;

wherein:

the slip lock member is at least partially embedded within the second free end of the shoulder strap and includes a first flat portion extending to a second flat portion, the first flat portion including a window with a crossbar extending across the window that separates the window into a first slot and a second slot such that the crossbar and each of the first slot and the second slot are disposed within the first flat portion, and the second flat portion extending at an angle of less than 45° outward and away from the first flat portion; and the bulk strap includes a plurality of markings arranged along a length dimension of the bulk strap, and the window of the slip lock member exposes a portion of the bulk strap that extends through the first slot, over the crossbar and through the second slot of the slip lock member such that a single marking of the plurality of markings of the bulk strap is visible at the window when the bulk strap is moved to different positions in relation to the slip lock member.

9. The backpack of claim 8, wherein the markings comprise a series of sequential numbers spaced from each other along the length dimension of the bulk strap.

10. The backpack of claim 8, further comprising a side support strap including a first end connected to the rear side and an upper portion of the backpack and a second end, wherein the side support strap extends from the first end of the side support strap to couple with an anchor structure at the front side of the backpack and further extends from the anchor structure back to the rear side to couple with support structure at the rear side and a lower portion of the backpack, and the anchor structure is disposed within a pocket defined between a front, outermost panel and an underlying panel at the front side of the backpack.

11. The backpack of claim 10, further comprising an anchor pad extending from the rear side at or near a lengthwise side edge of the backpack, wherein the bulk strap is affixed via stitching to the anchor pad at the first end of the bulk strap.

12. The backpack of claim 11, wherein the side support strap couples with the anchor pad.

13. The backpack of claim 12, further comprising a locking clip secured to the anchor pad, wherein the side support strap is movably coupled so as to extend through the locking clip so as to releasably lock the side support strap in a fixed position with the anchor pad.

14. The backpack of claim 10, wherein the bulk strap and the side support strap are independently and selectively adjustable to tighten and pull the front side toward the rear side of the main portion when the backpack is worn by a user.

15. A method of leveling a backpack in relation to shoulders of a user wearing the backpack, the backpack comprising a main body and a pair of shoulder straps, the main body including a front side and a rear side, the method comprising:

facilitating placement of each shoulder strap over a corresponding shoulder of the user, each shoulder strap extending from a first fixed end at an upper portion of the rear side to a second free end; and adjusting a shoulder strap leveling structure coupled with each of the shoulder straps, the shoulder strap leveling structure comprising a first bulk strap and a corresponding first slip lock member secured at the second free end of one of the shoulder straps and a second bulk strap and a corresponding second slip lock member secured proximate the second free end of the other of the shoulder straps, wherein the adjusting comprises:

adjusting the first bulk strap in relation to the first slip lock member such that a free end of the first bulk strap extending beyond the first slip lock member changes with the adjusting; and adjusting the second bulk strap in relation to the second slip lock member such that a free end of the second bulk strap extending beyond the second slip lock member changes with the adjusting;

wherein:

each of the first and second bulk straps includes a plurality of markings arranged along a length dimension of the bulk strap;

each of the first and second slip lock members is at least partially embedded within the second free end of the corresponding shoulder strap and includes a first flat portion extending to a second flat portion, the first flat portion including a window with a crossbar extending across the window that separates the window into a first slot and a second slot such that the crossbar and each of the first slot and the second slot are disposed within the first flat portion, and the second flat portion extending at an angle of less than 45° outward and away from the first flat portion; and each of the first bulk strap and the second bulk strap is adjusted with the first slip lock member or the second slip lock member by moving a portion of the first bulk strap or the second bulk strap through the first slot, over the crossbar and through the second slot of the first slip lock member or the second slip lock member such that a single marking of the first bulk strap visible at the window of the first slip lock member is a same single marking of the second bulk strap visible at the window of the second slip lock member.

* * * * *